US007218167B2

(12) United States Patent
Chatal et al.

(10) Patent No.: US 7,218,167 B2
(45) Date of Patent: May 15, 2007

(54) ELECTRIC REFERENCE VOLTAGE GENERATING DEVICE OF IMPROVED ACCURACY AND CORRESPONDING ELECTRONIC INTEGRATED CIRCUIT

(75) Inventors: Joel Chatal, Carquefou (FR); Abdellatif Bendraoui, Saint Julien de Concelles (FR); Mikael Tual, Saint-Nazaire (FR)

(73) Assignee: Atmel Nantes SA, Nantes Cedex (FR)

( * ) Notice: Subject to any disclaimer, the term of this patent is extended or adjusted under 35 U.S.C. 154(b) by 120 days.

(21) Appl. No.: 11/062,888

(22) Filed: Feb. 22, 2005

(65) Prior Publication Data

US 2005/0206443 A1 Sep. 22, 2005

(30) Foreign Application Priority Data

Feb. 20, 2004 (FR) ..... 04 01753

(51) Int. Cl.
*G05F 1/10* (2006.01)

(52) U.S. Cl. ..... 327/539

(58) Field of Classification Search ..... 327/539
See application file for complete search history.

(56) References Cited

U.S. PATENT DOCUMENTS 6,531,911 B1 * 3/2003 Hsu et al. ..... 327/512
7,012,416 B2 * 3/2006 Marinca ..... 323/316
7,034,514 B2 * 4/2006 Tachibana et al. ..... 323/313
2002/0125938 A1 9/2002 Kim et al. ..... 327/539

FOREIGN PATENT DOCUMENTS

| | | |
|---|---|---|
| EP | 0 197 965 | 1/1991 |
| EP | 0 504 983 A1 | 9/1992 |
| FR | 2 842 317 | 1/2004 |

OTHER PUBLICATIONS

V. Gupta et al., "Predicting the Effects of Error Sources in Bandgap Reference Circuits and Evaluating Their Design Implications", IEEE, XP002300515, vol. 3, 2002, pp. III-575 to III-578.
H. Banba et al., "A CMOS Bandgap Reference Circuit with Sub-1-V Operation", IEEE Journal of Solid-State Circuits, vol. 34, No. 5, May 1999, pp. 670-674.

* cited by examiner

*Primary Examiner*—Kenneth B. Wells
(74) *Attorney, Agent, or Firm*—Westman, Champlin & Kelly

(57) ABSTRACT

The present invention relates to a device for generation of a reference electrical voltage. The device includes a first current generator outputting a current proportional to temperature. The first current generator comprises at least one operational amplifier and two branches in parallel, a first branch comprising a first current source and a first bipolar transistor, and a second branch comprising a second current source, a first resistance and a second bipolar transistor. A second current generator outputs a current conversely proportional to temperature. The device includes means of summating the currents so as to obtain a voltage independent of the said temperature, and means of reducing dependence of the current circulating in the said first branch on the value of the said first resistance. The reduction means comprises at least one second resistance with a non-adjustable value.

11 Claims, 8 Drawing Sheets

ELECTRIC REFERENCE VOLTAGE GENERATING DEVICE OF IMPROVED ACCURACY AND CORRESPONDING ELECTRONIC INTEGRATED CIRCUIT

FIELD OF THE INVENTION

The field of the invention is the design of electronic and microelectronic circuits. More precisely, the invention relates to the field of generation of reference electrical voltages used in all applications that require a controlled voltage with very small variations as a function of the temperature, as a function of variations in the power supply voltage or as a function of variations of technological parameters for manufacturing of the various components.

This type of electrical reference voltage is necessary particularly in portable equipment powered by batteries (radiotelephones, portable computers, etc.) and in systems using high performance complex electronic circuits and more generally in integrated circuits based on microcontrollers.

Two current sources with opposite dependences on temperature are usually used to generate a reference voltage that is as little dependent as possible on temperature variations:

- a first current source called a PTAT (Proportional To Absolute Temperature) source, that depends positively on temperature variations;
- a second current source called a CPTAT (Conversely Proportional To Absolute Temperature) source, that depends negatively on temperature variations.

Such a reference voltage source based on PTAT/CPTAT currents is also described in an article published in the IEEE Journal of Solid-State Circuits in May 1999 entitled "A CMOS Bandgap Reference Circuit with Sub-1-V Operation" by Hiromeri Bomba et al.

More precisely, the positive temperature coefficient of the PTAT current source is usually obtained from a voltage difference between two diodes, or between two base-emitter junctions of forward biased bipolar transistors, and the negative temperature coefficient of the CPTAT current source is obtained from the voltage at the terminals of a diode or the base-emitter junction of a forward biased bipolar transistor.

Conventionally, cascading or regulation is used to make the generated reference voltage independent of variations in the power supply voltage.

French patent application No. FR 2842317 entitled "Source de tension de référence, capteur de température, détecteur de seuil de température, puce et systéme correspondent" (Reference voltage source, temperature sensor, temperature threshold detector, chip and corresponding system), in the name of the same Applicant as this patent application, gives a more detailed description of an example device for generation of a reference voltage according to prior art.

FIG. 1 shows an example of a "bandgap" type reference voltage generation device according to the prior art capable of operating at a low power supply voltage with a low quiescent current. This type of device comprises:

- a PTAT type current source 10 comprising two bipolar transistors Q2 and Q1, for which the ratio of the emitter surfaces is equal to S2/S1;
- a CPTAT type current source 11;
- a biasing current source 12, not illustrated in FIG. 1;
- a current summation resistance Rs 13.

A first operational amplifier 14 biases the bipolar components of the circuit and generates a current proportional to the temperature (PTAT), the value of which may be adjusted by varying the value of the resistance R1.

A second operational amplifier 15 is used in a follower circuit, and is connected to the smallest bipolar transistor Q1: it is used to generate a current conversely proportional to the temperature (CPTAT), the value of which can be adjusted by varying the resistance R2.

These two currents, one proportional to temperature (PTAT) and the other conversely proportional to temperature (CPTAT) respectively are added in a third resistance Rs 13 to generate an adjustable voltage that can be made independent of the temperature by adjustment of the PTAT and CPTAT currents.

This type of circuit also includes a current source not shown in FIG. 1 that includes a start circuit that is active on power up, and supplies the biasing current for the two operational amplifiers 14 and 15.

The device in FIG. 1 outputs a reference voltage VREF, for which the expression is given by VREF=Rs (I1+I2).

For each bipolar transistor Q1 and Q2, there is a base-emitter voltage $$V_{BE} = \frac{kT}{q}\ln\frac{I_E}{I_S}$$

(namely $$V_{BE1} = \frac{kT}{q}\ln\frac{I_{E1}}{I_{S1}}$$

for Q1, and $$V_{BE2} = \frac{kT}{q}\ln\frac{I_{E2}}{I_{S2}}$$

for Q2, where $I_E$ and $I_S$ denote the emitter and saturation currents of transistors Q1 and Q2 respectively, and T is the absolute temperature.

When the input voltages at points A and B in the operational amplifier 14 are identical, namely v(A)=v(B), $\Delta V_{BE}=V_{BE1}-V_{BE2}$ can be expressed in the form $$\Delta V_{BE} = \frac{kT}{q}\ln\frac{I_{S2}}{I_{S1}},$$

where currents $I_{S2}$ and $I_{S1}$ are proportional to the size of the emitters of the bipolar transistors Q2 and Q1.

The following expressions are then deduced:

$$I1 = \frac{\Delta V_{BE}}{R_1} = \frac{kT}{qR_1}\ln\frac{S_2}{S_1},$$

which is proportional to the absolute temperature T, where k and q are constant, and where $S_2/S_1$ denotes the ratio of the surfaces of emitters of the two bipolar transistors $Q_2$ and $Q_1$, and $$I2 = \frac{V_{BE1}}{R_2}$$

that is conversely proportional to the temperature T.

The reference voltage VREF is then expressed as follows $$VREF = R_S\left(\frac{kT}{qR_1}\ln\frac{S_2}{S_1} + \frac{V_{BE1}}{R_2}\right) = \frac{kTR_S}{qR_1}\ln\frac{S_2}{S_1} + \frac{R_S V_{BE1}}{R_2}.$$

The first term $$\frac{kTR_S}{qR_1}\ln\frac{S_2}{S_1}$$

in this equation is proportional to the absolute temperature T, and the second term $$\frac{R_S V_{BE1}}{R_2}$$

is conversely proportional to T. Thus, if the absolute value of the temperature coefficients in each of these two terms can be made equal, the voltage VREF produced at the output from the device in FIG. 1 could theoretically be made independent of variations in the temperature T.

FIG. 2, that will not be described in more detail herein, introduces an example embodiment of the device shown diagrammatically in FIG. 1. The same functional elements are denoted by the same numeric references in FIGS. 1 and 2.

The current source (that includes a starting circuit that is active on power up and outputs the biasing current for the two operational amplifiers 14 and 15) that is not shown in FIG. 1, is illustrated in FIG. 2 as numeric reference 12.

It has also been proposed to add an additional variable resistance to existing reference voltage generation devices in series with the PTAT generator, to adjust the value of the current proportional to the temperature output by the generator. This is called "trimming".

Reference voltage generation devices according to prior art like those for example illustrated in FIGS. 1 and 2, include integrated components such as polysilicon resistances.

One disadvantage of these components is that their value can vary by about plus or minus 20% as a function of the parameters of the technology from which they are made (typically as a function of the silicon wafer on which they are made). Therefore, these components have a poor absolute precision, which has the effect of inducing a dispersion of the reference voltage produced at the output, both as a function of the temperature and as a function of the technological parameters (process variations).

Therefore, one disadvantage of the "Bandgap" type techniques for the generation of reference voltages according to prior art is the inaccuracy of the generated voltage, depending on variations of the temperature and technological parameters.

The addition of an additional variable resistance in series with the PTAT generator (trimming resistance) provides a means of adjusting the value of the current proportional to the temperature output by the generator, but the resistance has to be adjusted whenever any process variations occur.

Therefore, it is necessary to act on each device to adjust the value of the trimming resistance as a function of process variations, which is particularly tedious.

BACKGROUND OF THE INVENTION

The main purpose of the invention is to overcome these disadvantages according to prior art.

More precisely, one purpose of the invention is to provide a technique for generation of an electrical reference voltage that has a better precision than reference voltages generated using techniques according to prior art. One particular purpose of the invention is to improve the precision of the reference voltage generated with regard to temperature variations and/or technological parameters for manufacturing of components (particularly when using polysilicon resistance type components).

In other words, the purpose of the invention is to provide a technique for generating a reference electrical voltage to reduce the dispersion of the output voltage from a "bandgap" type device.

Another purpose of the invention is to propose such a technique that is simple and inexpensive to implement, and which does not require adjustment of specific components.

In particular, the purpose of the invention is to provide such a technique that will limit actions necessary to adjust the values of components after they have been assembled, when their operating conditions change.

Another purpose of the invention is to propose such a technique that does not significantly increase the complexity of reference voltage generation devices compared with prior art.

Another purpose of the invention is to provide such a technique that is suitable for devices for generation of low electrical reference voltages for which operation is based on summation of currents.

SUMMARY OF THE INVENTION

These objectives, and others that will become clear later, are achieved using a device for generation of a reference electrical voltage comprising a first current generator outputting a current proportional to temperature and a second current generator outputting a current conversely proportional to temperature, and means of summating of the said currents so as to obtain a voltage independent of the said temperature, the said first current generator comprising at least one operational amplifier and two branches in parallel, a first branch comprising a first current source controlled by the operational amplifier, and a first bipolar transistor, and a second branch comprising a second current source controlled by the operational amplifier, a first resistance and a second bipolar transistor.

According to the invention, this type of device for generation of an electrical reference voltage comprises means of reducing dependence of current circulating in the said first branch on the value of the said first resistance, the said reduction means comprising at least one second resistance with a non-adjustable value.

Thus, the invention is based on a quite new and inventive approach to the generation of a reference voltage, independent of temperature and variations in processes for manufacturing components used to make such a device. The invention proposes a technique for generation of a reference voltage that has better precision than techniques according to prior art due to a reduction in sensitivity to the values of the resistances used.

This technique is based on a "bandgap" type device based on operational amplifiers.

In particular, this type of bandgap provides a means of supplying an adjustable output voltage between 0 V and the power supply voltage. It can also operate at voltages less than 1 V.

The recent introduction of means for reducing dependence on the value of resistances makes it possible to eliminate the strong dispersion of the reference voltage generated at the output induced by variations of plus or minus 20% in the values of resistances (for example polysilicon resistances) as a function of technological parameters used for their manufacture.

If this second resistance is made using the same technological process as the first, the variation of its value will thus be similar to the variation of the first resistance, which will enable fine compensation of dependence on the value of the first resistance to the current circulating in the first branch.

In particular, the use of such a resistance with a non-adjustable value provides a means of eliminating problems related to adjustment of components, since the value of the resistance is adjusted when it is integrated into the reference voltage generation device.

The invention thus eliminates the component adjustment step that was necessary according to prior art as soon as any change in the resistivity occurred.

Advantageously, the said reduction means act so as to increase the current circulating in the said first branch when the resistivity of the said first resistance is higher than a reference value, and to reduce this current when the resistivity of the said first resistance is smaller than a reference value.

Thus, a relative balance is maintained between currents generated by the first current generator and the second current generator in the device when technological parameters change, which reduces dispersion of the reference voltage generated at the output.

Advantageously, the said second resistance is placed on the said second branch, on a link made between the said first and second current sources.

This second resistance is thus placed in series with the bipolar transistor in the second branch.

In particular, the second resistance can be mounted in series between the second current source and a power supply to the voltage generation device.

Preferably, the said second resistance is chosen such that ratio of the said currents proportional and conversely proportional to the temperature remain within a predetermined interval of values when the value of the said first resistance varies.

This interval of values is as narrow as possible, to assure that the ratio of the currents generated by each of the first and second generators are as constant as possible, as a function of the variation of technological parameters.

Advantageously, the first and second resistances are made using the same technology, so that they have the same behaviour as a function of variations in operating conditions of the said device.

In particular, the said first and second resistances may be polysilicon resistances made on the same wafer.

The invention also relates to an integrated electronic circuit comprising a device for generation of a reference electrical voltage comprising a first current generator outputting a current proportional to the temperature and a second current generator outputting a current conversely proportional to the temperature, and means of summating the said currents so as to obtain a voltage independent of the said temperature. The first current generator comprises at least one operational amplifier and two branches in parallel, namely a first branch comprising a first current source controlled by the operational amplifier, and a first bipolar transistor, and a second branch comprising a second current source controlled by the operational amplifier, a first resistance and a second bipolar transistor.

Such a generation device comprises means of reducing dependence of the current circulating in the said first branch to the value of the said first resistance, the said reduction means comprising at least one second resistance with a non-adjustable value.

DESCRIPTION OF THE DRAWINGS

Other characteristics and advantages of the invention will become clearer after reading the following description of a preferred embodiment given as a simple illustrative and non-limitative example, and the attached drawings among which.

DETAILED DESCRIPTION OF THE PREFERRED EMBODIMENTS

The main purpose of the invention is based on the introduction of means of reducing dependence on the value of resistances of PTAT type current in a reference voltage generation device by summation of currents.

Figure 3:
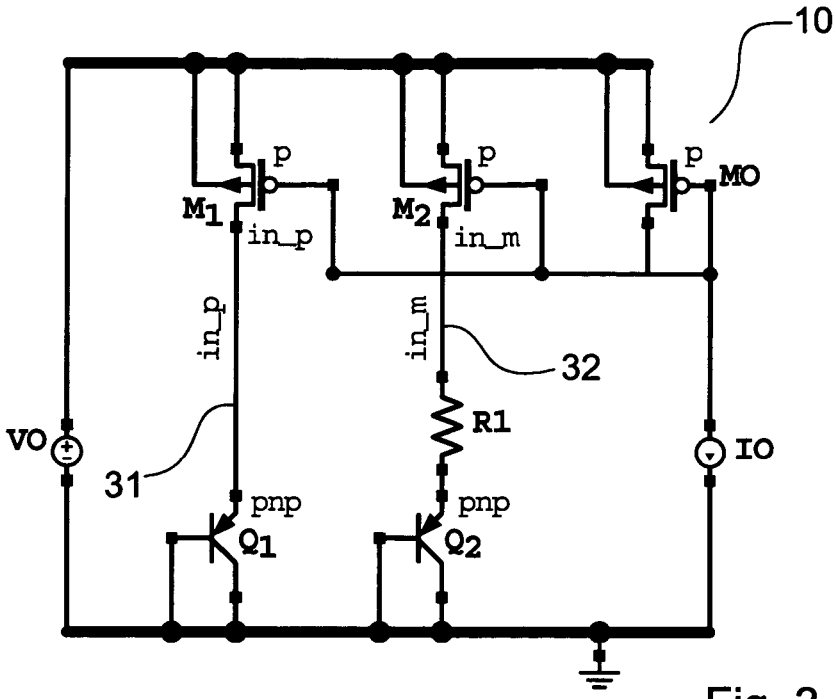
FIG. 3 illustrates bipolar transistors and current mirrors used to generate a PTAT current in the device in FIG. 2.
Figure 4:
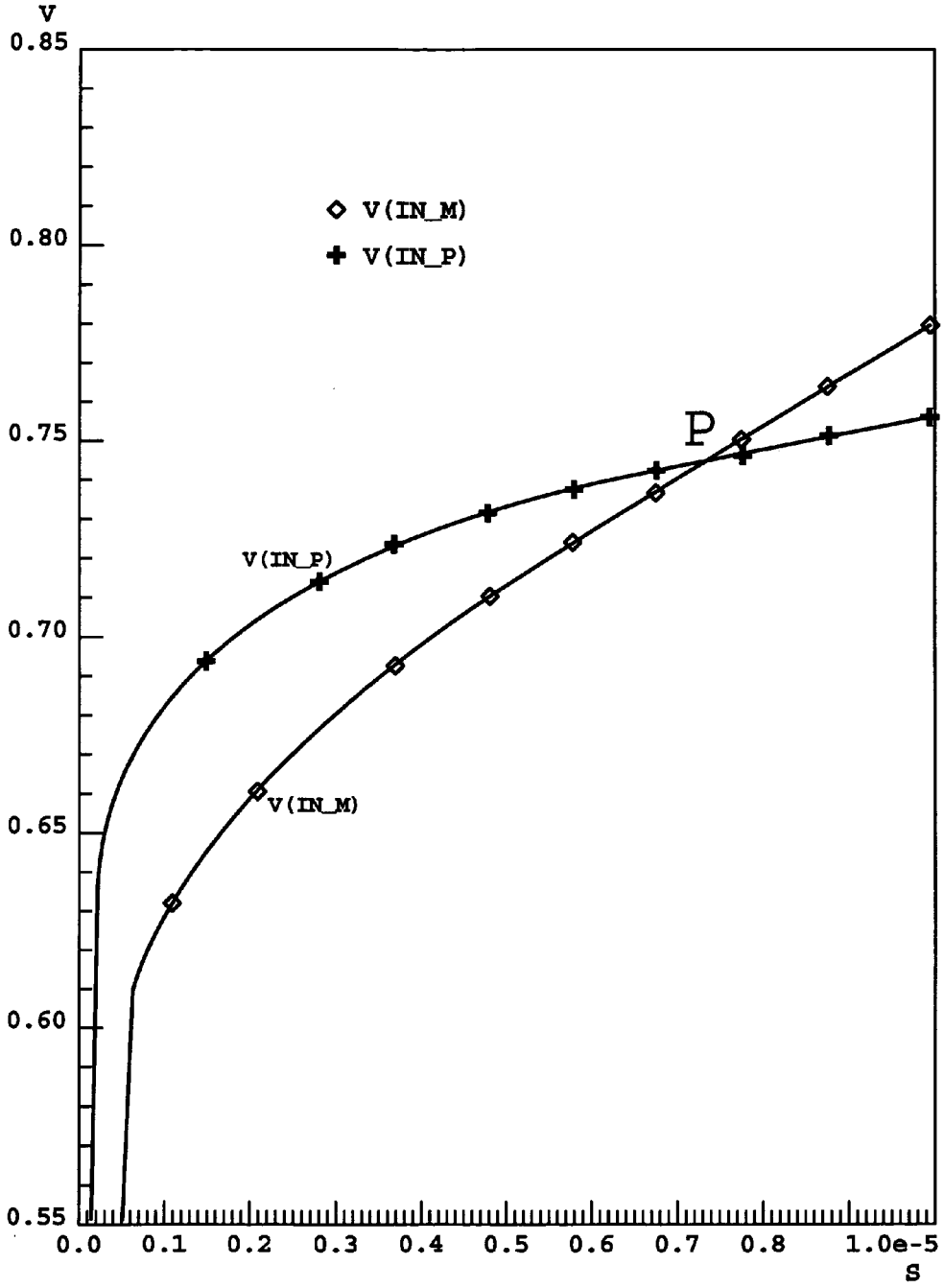
FIG. 4 shows curves of input voltages to the operational amplifier 14 in FIG. 2 as a function of the current I1.
Figure 5:
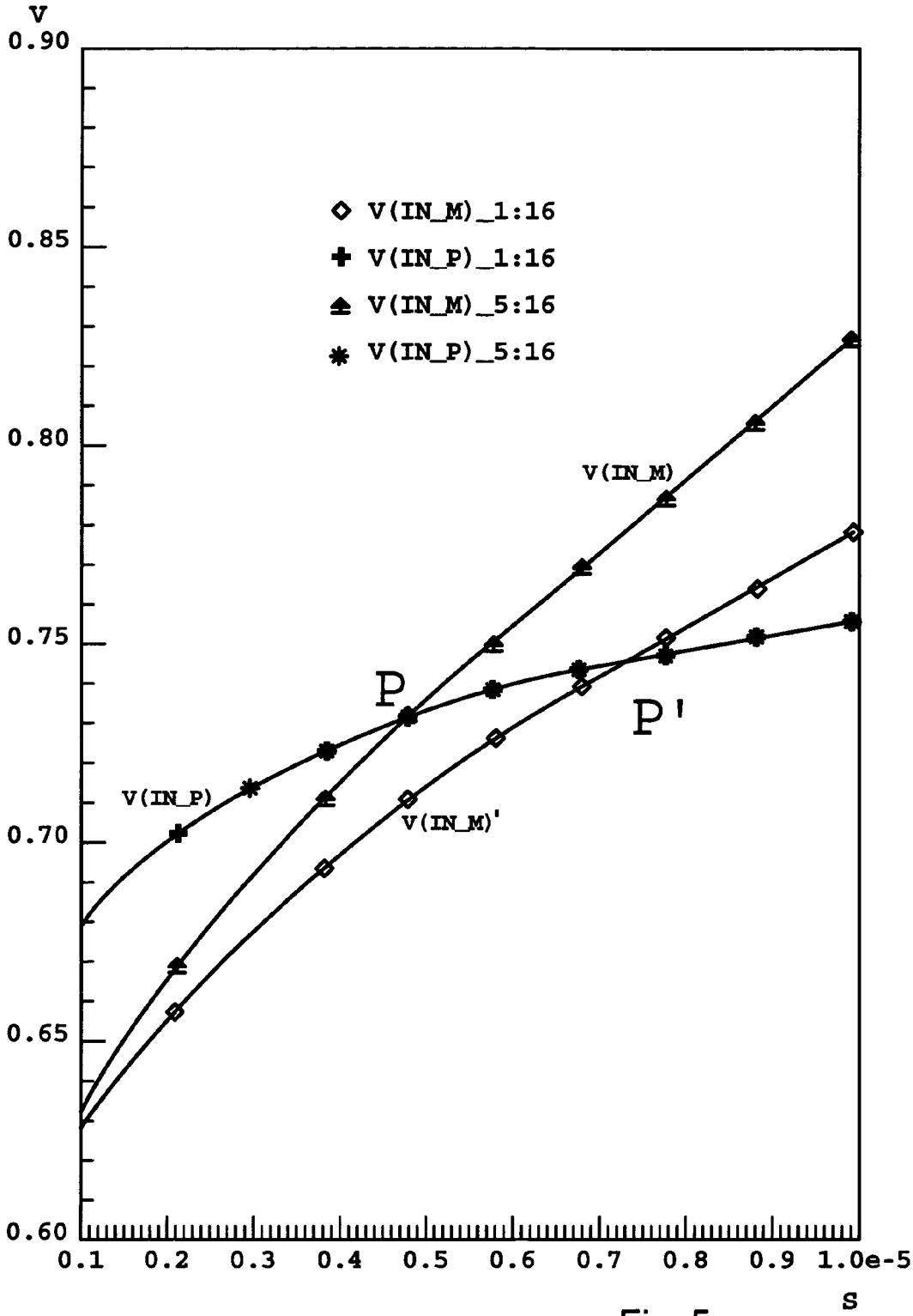
FIG. 5 illustrates the shift of the curve of the input voltage V(IN-M) in FIG. 4, under the effect of a change in the resistivity of components used in the device in FIG. 2.

We will present the problem of prior art that the invention is intended to solve, with reference to FIGS. 3 to 5.

Figure 1:
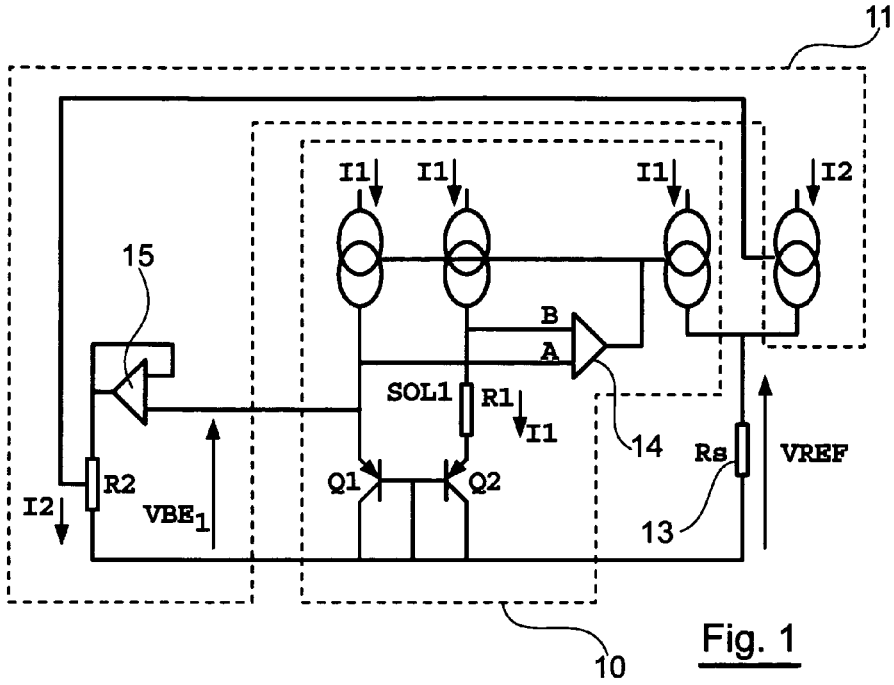
FIG. 1, already commented upon above in relation to prior art, shows a block diagram of a "bandgap" type device for generation of a reference voltage.
Figure 2:
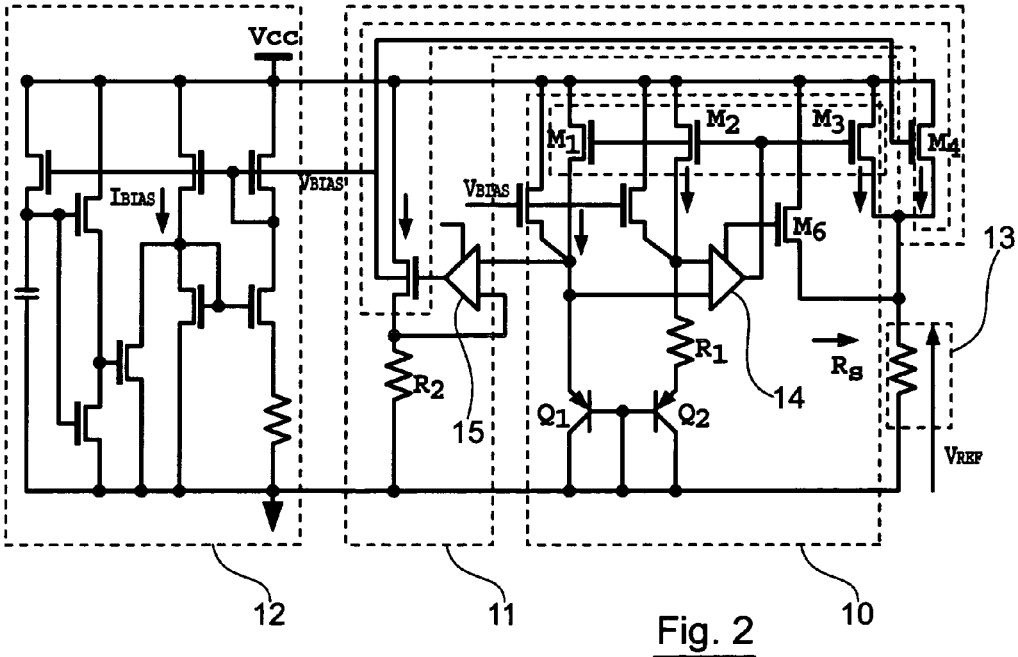
FIG. 2, also commented upon above in relation to prior art, illustrates an example embodiment of the device in FIG. 1.

To achieve this, FIG. 3 illustrates the PTAT type current generator reference 10 shown in FIGS. 1 and 2 in detail. This type of generator 10 comprises two branches in parallel 31 and 32:

- the first branch 31 includes a first bipolar transistor Q1 of the pnp type and a current source formed by the PMOS transistor M1 mounted in current mirror;
- the second branch 32 includes a second bipolar transistor Q2 of the pnp type, a current source formed by the PMOS transistor M1 mounted in current mirror and a first resistance R1.

An additional PMOS transistor M0 and a current source 10 have been added to supply current to the bipolar transistors Q1 and Q2.

The voltages at points in_p and in_m, denoted V(in_p) and V(in_m), represent the two input voltages at points A and B of the operational amplifier 14 in FIGS. 1 and 2 as a function of the current (identical) injected at these points A and B. As illustrated in FIG. 4, which shows the variation of these two voltages V(in_p) and V(in_m) as a function of the current I1 in branches 31 and 32, V(in_p)=V(in_m) at the regulating point P. It will be noted in FIG. 4 that the abscissa of the two curves corresponds to the current (identical) injected at points A and B (expressed in tens of microamperes μA, namely $1.^{e-5}$ A). The ordinate of these curves corresponds to the voltage at points A and B, expressed in volts V.

When the value of the resistance R1 decreases (due to variations in technological manufacturing parameters, also called "process variations"), the current $$I1 = \frac{\Delta V_{BE}}{R_1}$$

in the second branch 32 increases with a linear variation according to the equation $$I1 = \frac{\Delta V_{BE}}{R_1} = \frac{kT}{qR_1}\ln\frac{S_2}{S_1}.$$

The regulation point P of the "bandgap" type generation device (in other words the point at which V(in_p)=V(in_m)) then moves from point P to point P' under the effect of the displacement of the curve representative of the voltage V(in_m) as shown in FIG. 5. Once again, the abscissa of the two curves corresponds to the current (identical) injected at points A and B (expressed in tens of microamperes μA, namely $1.^{e-5}$ A). The ordinate of these curves corresponds to the voltage at points A and B expressed in volts V.

The regulating point P corresponds to an initial value of the resistance R1, and the new regulation point P' corresponds to a reduction of 20% of the value of R1 compared with point P.

At the same time, the current that passes through the resistance R2 of the CPTAT current generator 11 in FIGS. 1 and 2 increases, because the base-emitter voltage $V_{BE1}$ of the bipolar transistor Q1 also increases. We have:

$$V_{R2} = V_{BE1} = \log\left(\frac{I1}{IS1}\right)$$

where IS1 is a constant and VR2 denotes the voltage at the terminals of the resistance $R_2$; and $$I2 = \frac{V_{R2}}{R2} = \frac{V_{BE1}}{R2}.$$

Consequently, when the value of the resistance R1 reduces as a function of process variations (typically in a proportion of about 20%), the currents I1 and I2 both increase according to the shift in the regulating point P illustrated in FIG. 5, and the voltage produced at the output from the reference voltage generation device ("bandgap" type) then increases according to the equation VREF=Rs (I1+I2).

However, as mentioned above, the current 11 increases linearly with R1 according to a K/R1 law, where K is a constant (since $$I1 = \frac{kT}{qR_1}\ln\frac{S_2}{S_1}\Big),$$

while the current I2 increases linearly with R2 following a K'/R2 law where K' is a constant, and logarithmically according to a law in ln(I/R1).

Therefore in the expression $$VREF = \frac{kTRs}{qR_1}\ln\frac{S_2}{S_1} + \frac{RsV_{BE1}}{R_2},$$

the first term in the equation, in $Rs/R_1$, remains constant when the resistivity of the polysilicon components varies, while the second term varies as a function of the absolute value of the resistivity p of these components.

Therefore, the global effect is twofold:

- firstly, there is an increase in the dispersion of the output voltage VREF;
- secondly, the temperature coefficient of the voltage VREF becomes distorted, since the current I2 (that depends negatively on the temperature, of the CPTAT type) increases faster than the current I1 (that depends positively on the temperature, of the PTAT type).

Figure 6:
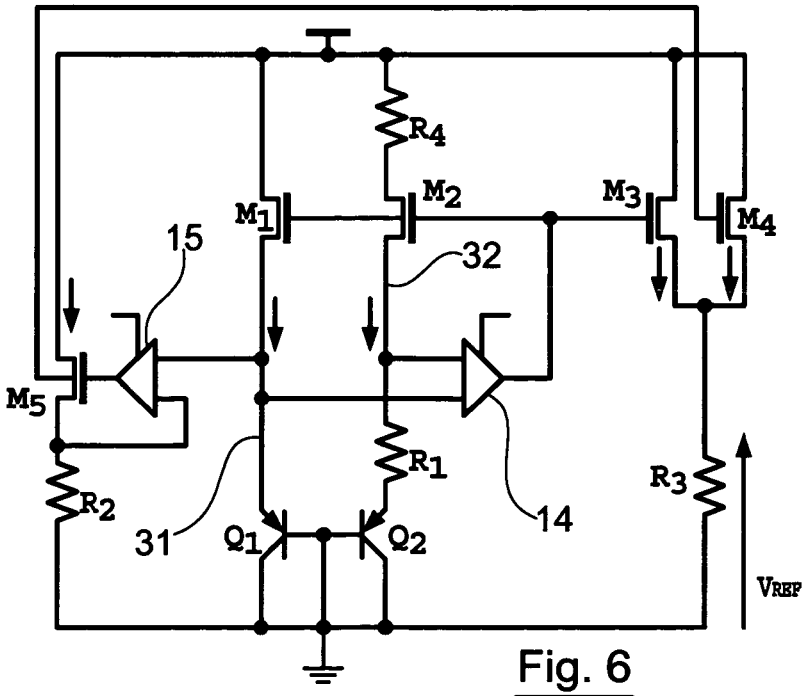
FIG. 6 shows the general diagram of a device for the generation of a "bandgap" type reference voltage according to the invention, in which an additional resistance R4 was added into the PTAT generator to compensate for variations in the resistivity of the components.

The inventors of this patent application propose a new type of reference voltage generation device to overcome these problems, one particular embodiment being illustrated in FIG. 6.

The circuit in FIG. 6 corresponds to the circuit in FIGS. 1 and 2, in which an additional transistor R4 has been added in series in the second current branch 32 of the current mirror of the PTAT current generator 10. The purpose of this type of additional resistance R4 with a non-adjustable value is to reduce the sensitivity of the output voltage VREF to variations of the values of resistive components of the device.

Figure 7:
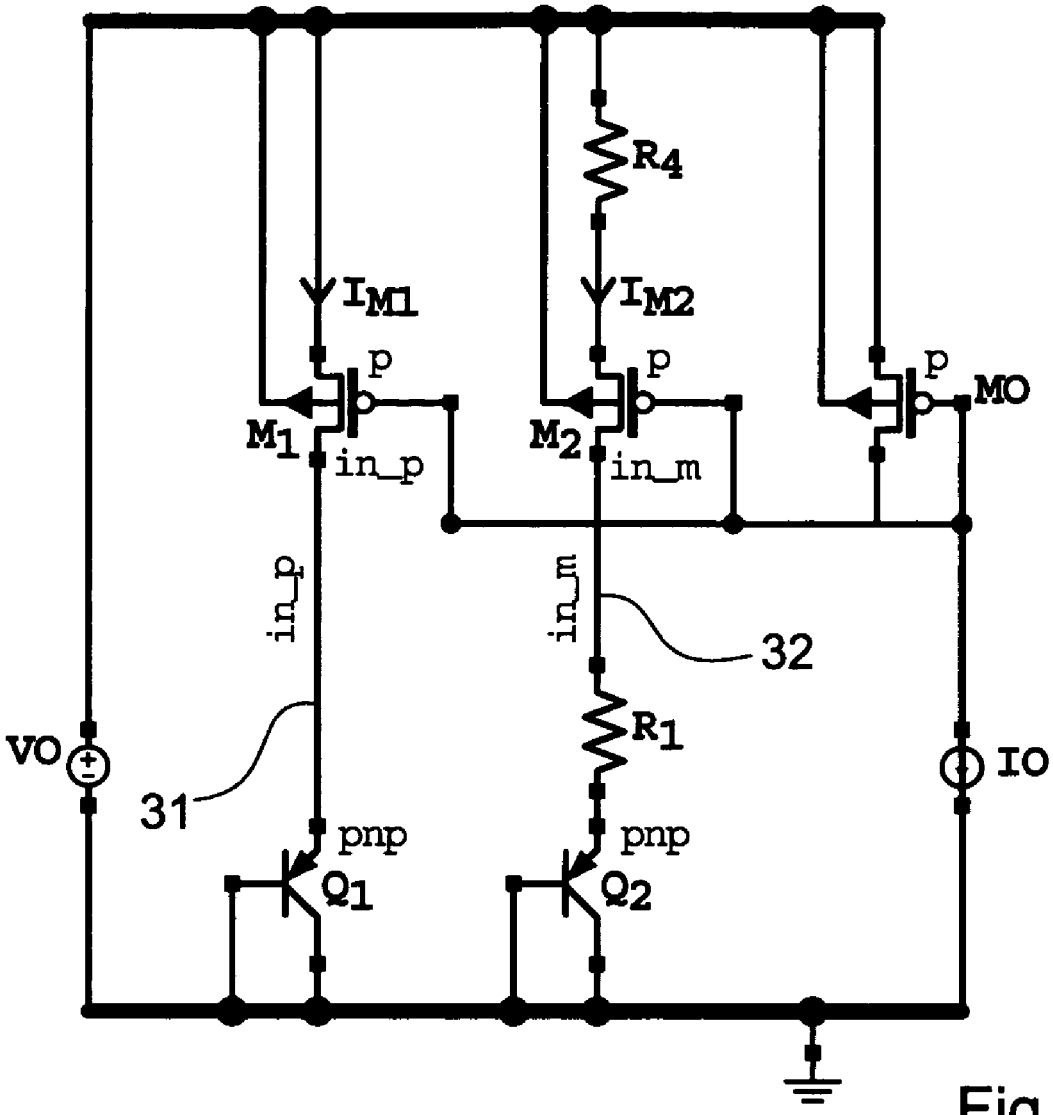
FIG. 7 describes the PTAT generator of the device in FIG. 6 in more detail.

More precisely, the effect of the resistance R4 may be illustrated from the diagram in FIG. 7. $I_{M1}$ represents the current that circulates in the first branch 31 of the PTAT generator, and $I_{M2}$ represents the current that circulates in the second branch 32 of the PTAT generator.

The relation between the values of the currents $I_{M1}$ and $I_{M2}$ may be expressed in the following form:

$$\frac{I_{M1}}{I_{M2}} = \frac{(V_{gs_{M1}} - V_T)^2}{(V_{gs_{M2}} - V_T)^2} \text{ and } (V_{gs_{M1}} - V_{gs_{M2}}) = R4 * I_{M2}$$

where $V_{gs_{M1}}$ and $V_{gs_{M2}}$ denote the voltage between the gate and the source of transistors M1 and M2 respectively, and $V_T$ is the threshold voltage of these transistors.

When the value of R1 reduces, the current $I_{M2}$ passing through the transistor M2 increases as described above with reference to FIG. 3. At the same time, the value of the resistance R4 also reduces since resistances R1 and R4 are made using the same technology: for example, R1 and R4 are both polysilicon resistances made on the same wafer.

Note that the resistance R4 has a non-adjustable value. In this case, process variations slightly modify the value of this resistance. There is no need for any action to trim the value of R4.

When R4 reduces, $(V_{gs_{M1}}-V_{gs_{M2}})$ also reduces and therefore the $I_{M1}/I_{M2}$ ratio also reduces.

In summary, two opposite effects are obtained:

firstly, the value of the current $I_{M2}$ increases due to the reduction of R1;

secondly, the ratio $I_{M1}/I_{M2}$ reduces due to reduction in the value of R4.

Therefore, by adjusting the ratio R4/R1, the current $I_{M1}$ can be kept practically constant when the resistivity of the components changes as a function of variations of technological parameters. The voltage $V_{BE1}$ then remains constant and the CPTAT current $$I2 = \frac{V_{BE1}}{R2}$$

only depends on R2.

The invention thus proposes a technique for generation of a reference voltage with better precision than is possible with techniques according to prior art, due to a reduction in the sensitivity to values of the resistances and not requiring any readjustment of the value of components if variations occur in the temperature, power supply, etc.

In order to reuse the same notations that were used above with reference to FIG. 3, the current I1=$I_{M2}$ changes as a function of the resistivity of the components following a linear law in K/R (where R is a resistance value and K is a constant) and the current I2 also changes as a function of the resistivity of components following a quasi-linear law. Thus, the temperature coefficient of the reference voltage produced at the output from the device VREF=Rs(I1+I2) may be more precise since the dispersion of the ratio I1/I2 is smaller.

Figure 8:
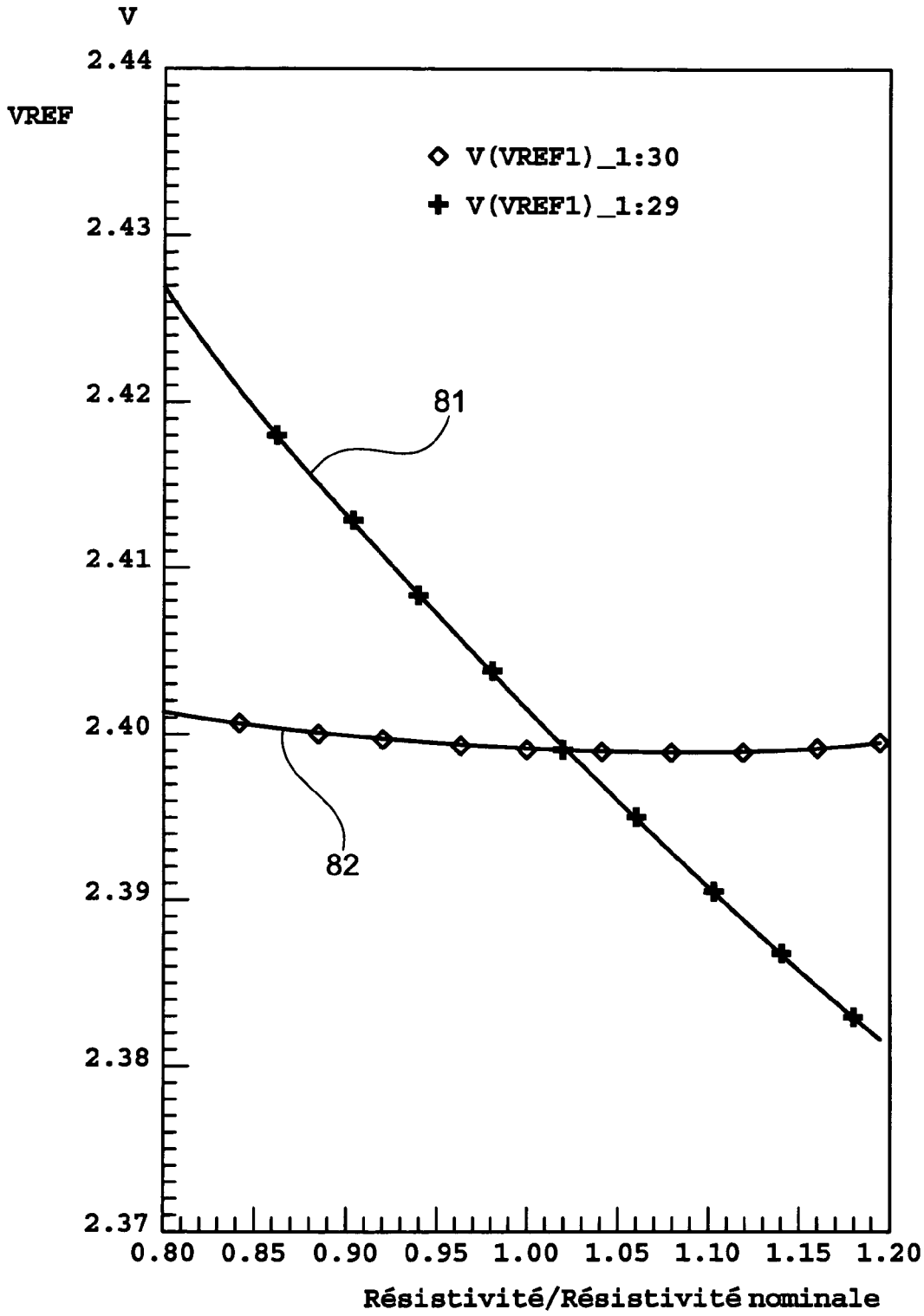
FIG. 8 shows curves representative of the reference voltage generated at the output from a "bandgap" device according to prior art and a "bandgap" device according to the invention, as a function of the nominal resistivity of resistive components used in such devices.

This is illustrated in FIG. 8, which shows the variation of the reference voltage VREF as a function of variations in the resistivity of components of a reference voltage generation device:

as illustrated in FIG. 2, i.e. without any additional resistance R4 (curve reference 81);

as illustrated in FIG. 7, i.e. with an additional resistance R4 according to the invention (curve reference 82).

The abscissa of the curves in FIG. 8 represents the resistivity of polysilicon with respect to the nominal resistivity (thus, for example an abscissa of 1.2 corresponds to an increase in the resistivity of 20%), and the ordinate VREF corresponds to the "bandgap" output voltage expressed in volts.

As can be seen, the reference voltage VREF output from the "bandgap" device according to the invention is practically independent of process variations: when the resistivity of components in the device changes, the voltage VREF then remains almost constant (curve reference 82). However according to prior art (curve reference 81), the voltage VREF dropped strongly when the resistivity of the components increased.

Figure 9:
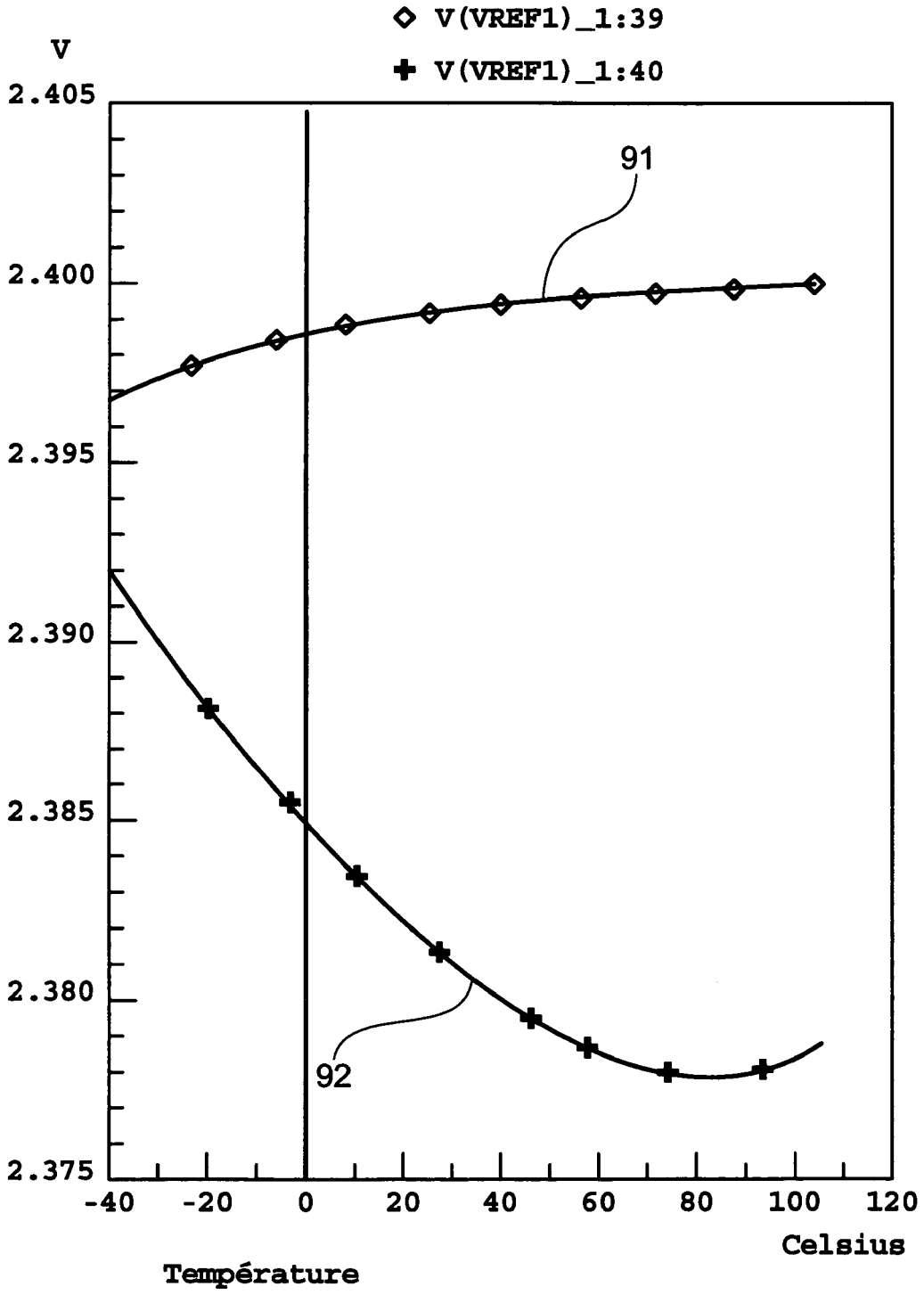
FIG. 9 shows curves representative of the reference voltage generated at the output from a "bandgap" type device according to prior art and a "bandgap" type device according to the invention, as a function of the temperature.

FIG. 9 shows the variation of the reference voltage VREF as a function of the temperature for each of these two cases (with an additional resistance R4 (reference curve 91) or without an additional resistance R4 (reference curve 92)), for a resistivity of polysilicon components equal to 1.2 times their nominal resistivity.

The abscissa of curves in FIG. 9 represents the temperature expressed in degree Celsius (° C.), and their ordinate represents the output voltage VREF of the "bandgap" expressed in Volts (V). In both cases, the variation of VREF with the temperature for a polysilicon resistivity equal to 1, is practically zero.

As can be seen, the stability of the voltage VREF generated at the output from the "bandgap" device as a function of temperature, is better in the case according to the invention, in which a resistance R4 was added in series in the branch 32 of the current mirror of the PTAT generator 10.

Figure 10:
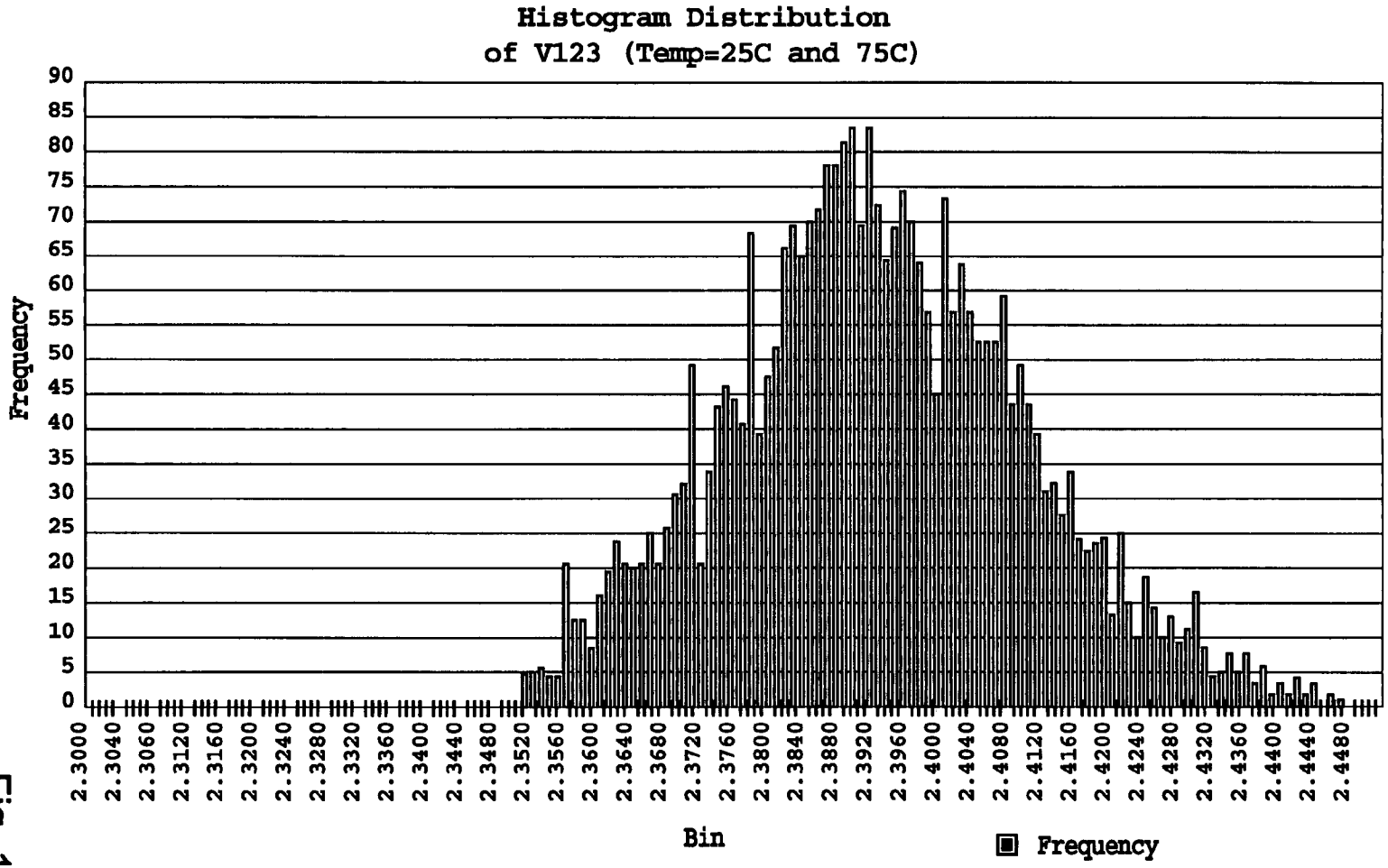
FIG. 10 shows a histogram of reference voltage measurements VREF at the output from a device according to the invention, made from 7 distinct (silicon) wafers.

FIG. 10 shows a histogram of different measurements of "bandgap" reference voltages VREF obtained from 7 distinct wafers. More precisely, this histogram corresponds to measurements of the "bandgap" type output voltage for a solution in which a resistance R4 was added. These measurements were made at 25° C. The abscissa of the histogram corresponds to the different measured values of the voltage VREF (in Volts), and the ordinate of each bar in the histogram represents the frequency (i.e. the number of parts) for each value of the voltage VREF shown in the abscissa (therefore no measurement unit is associated with the values obtained on the ordinate).

Other embodiments of the invention could be envisaged. In the example presented above with relation to FIG. 6, the means of reducing the dependence on the value of the resistance R1 of the current circulating in the first branch 31 of the PTAT current generator consist of a resistance R4 placed in series in this branch.

However, these means could also consist of an additional current injected into a first branch 31 of the PTAT current generator, that would compensate for variations in the current $I_{M1}$ due to the change in resistivity of R1. In particular, these means could consist of an additional current source proportional to the current I1 placed in parallel on the bipolar transistor Q1.

These means could also consist of one or several additional resistances external to the PTAT current generator circuit 10.

Note also that the use of precise resistance R1, R2 and Rs external to the circuit could also improve the stability of the resistance, but could increase the number of inputs/outputs and also the number of components used, and therefore cause a global increase in the cost of the "bandgap" type device according to the invention.

The invention claimed is:

1. Device for generation of a reference electrical voltage comprising:

a first current generator outputting a current proportional to temperature, wherein the said first current generator comprises at least one operational amplifier and two branches in parallel, a first branch comprising a first current source and a first bipolar transistor, and a second branch comprising a second current source, a first resistance and a second bipolar transistor;

a second current generator outputting a current conversely proportional to temperature;

means of summating the said currents so as to obtain a voltage independent of the said temperature; and means of reducing dependence of the current circulating in the said first branch on the value of the said first resistance, the said reduction means comprising at least one second resistance with a non-adjustable value and mounted in series between the said second current source and a power supply of said device.

2. Generation device according to claim 1, wherein the said reduction means act so as to increase the current circulating in the said first branch when the resistivity of the said first resistance is higher than a reference value, or to reduce this current when the resistivity of the said first resistance is smaller than said reference value.

3. Generation device according to claim 1, wherein the said second resistance is chosen such that the ratio of the said currents proportional and conversely proportional to the temperature remain within a predetermined interval of values when the value of the said first resistance varies.

4. Generation device according to claim 1, wherein the said first and second resistances are made using the same technology, so that they have the same behavior as a function of variations in operating conditions of the said device.

5. Generation device according to claim 4, wherein the said first and second resistances are polysilicon resistances made on the same wafer.

6. Integrated electronic circuit comprising a device for generation of a reference electrical voltage comprising:

a first current generator outputting a current proportional to the temperature and comprising at least one operational amplifier and two branches in parallel, including a first branch comprising a first current source and a first bipolar transistor, and a second branch comprising a second current source, a first resistance and a second bipolar transistor;

a second current generator outputting a current conversely proportional to the temperature;

means of summating the said currents so as to obtain a voltage independent of the said temperature; and means of reducing dependence of the current circulating in the said first branch on the value of the said first resistance, the said reduction means comprising at least one second resistance with a non-adjustable value and mounted in series between the said second current source and a power supply of said device.

7. A device for generating a reference electrical voltage, the device comprising:

a first current generator outputting a current proportional to temperature, wherein the said first current generator comprises at least one operational amplifier and two branches in parallel, a first branch comprising a first current source and a first bipolar transistor, and a second branch comprising a second current source, a first resistance and a second bipolar transistor;

a second current generator outputting a current conversely proportional to temperature;

a summation circuit, which sums the said currents so as to obtain a voltage independent of the said temperature; and a dependence reduction circuit comprising at least one second resistance with a non-adjustable value, which reduces dependence of the current circulating in the said first branch on the value of the said first resistance, and which is mounted in series between the second current source and a power supply of the device.

8. Generation device according to claim 7, wherein the said dependence reduction circuit acts so as to increase the current circulating in the said first branch when the resistivity of the said first resistance is higher than a reference value, or to reduce this current when the resistivity of the said first resistance is smaller than said reference value.

9. Generation device according to claim 7, wherein the said second resistance is chosen such that the ratio of the said currents proportional and conversely proportional to the temperature remain within a predetermined interval of values when the value of the said first resistance varies.

10. Generation device according to claim 7, wherein the said first and second resistances are made using the same technology, so that they have the same behavior as a function of variations in operating conditions of the said device.

11. Generation device according to claim 10, wherein the said first and second resistances are polysilicon resistances made on the same wafer.

* * * * *